US005101874A

United States Patent [19]

Weil

[11] Patent Number: 5,101,874

[45] Date of Patent: Apr. 7, 1992

[54] TANGENTIAL ROTARY SLICER

[75] Inventor: George Weil, Mississauga, Canada

[73] Assignee: David R. Webb Co., Inc., Edinburg, Ind.

[21] Appl. No.: 702,774

[22] Filed: May 17, 1991

[51] Int. Cl.[5] ..... B27L 5/02

[52] U.S. Cl. ..... 144/209 B; 144/177; 144/209 R; 269/50

[58] Field of Search ..... 269/47, 50; 144/162 R, 144/177, 209 R, 209 B, 209 C, 210, 211, 213

[56] References Cited

U.S. PATENT DOCUMENTS 144,938 11/1873 Williams ..... 144/177
828,065 8/1906 Smith et al. ..... 144/177
2,261,497 11/1941 Hill ..... 144/209 B
4,313,481 2/1982 Cremona ..... 144/209 B
4,323,101 4/1982 Cremona ..... 144/209 B

FOREIGN PATENT DOCUMENTS 29479 6/1909 Sweden ..... 144/209 B

*Primary Examiner*—W. Donald Bray
*Attorney, Agent, or Firm*—Barnes & Thornburg

[57] ABSTRACT

A veneer slicer having a flitch carried by a rotating carriage. A knife and pressure bar are carried on a reciprocating carriage which moves back and forth relative to the carriage. The carriage includes clamping elements for holding multiple flitches.

4 Claims, 3 Drawing Sheets

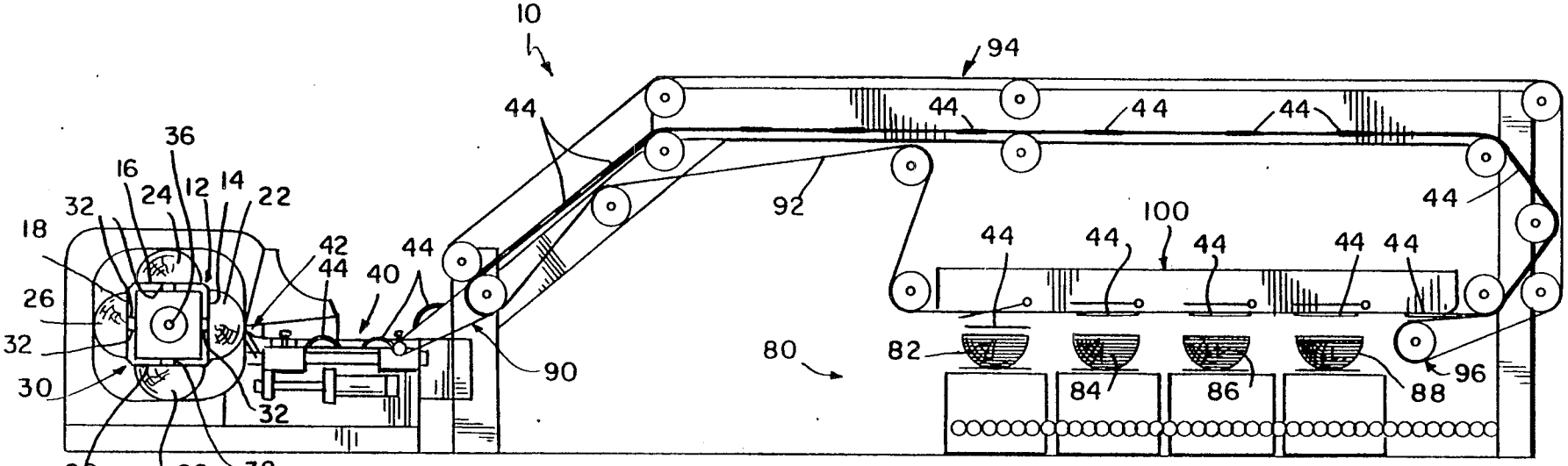
FIG. 1
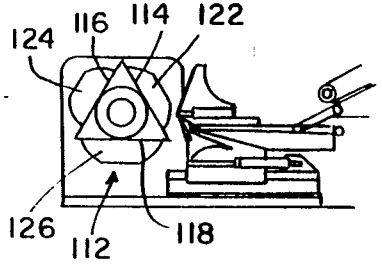
FIG. 2
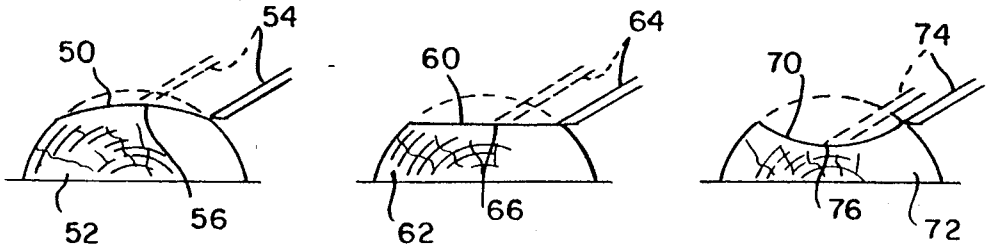
FIG. 3a
FIG. 3b
FIG. 3c

TANGENTIAL ROTARY SLICER

This invention relates to veneer slicers and particularly to a rotary slicer which has the capability to slice sheets from multiple flitches with each rotation of a flitch carriage.

Veneer lathes are known. Generally these devices rotate a circular cross-section flitch or a prepared whole log around an axis parallel to the flitch's or log's longitudinal extent and peel a continuous sheet of veneer from the outside cylindrical surface of the flitch or log. There are, for example, the systems of U.S. Pat. Nos.: 3,680,613; 4,287,462; and, 4,313,481.

Veneer slicers are also known. There are, for example, the slicers of U.S. Pat. Nos.: 793,306; 3,441,069; 3,680,612; 3,905,408; 4,089,354; and, 4,587,616.

Control systems for controlling the relative positions of workpieces and cutting tools are also known. There are, for example, the systems illustrated in the above identified patents and in U.S. Pat. Nos.: 3,698,268; 3,834,256; 3,851,550; 3,987,350; 4,066,944; 4,136,302; 4,291,262; and, 4,350,065. There are also the control systems described in, for example, Linear Electro-Hydraulic Stepper Drive-Operation, Installation and Maintenance Manual-Model LS-300, Olsen Controls, Inc., and Profiler II Operator Manual, Kiowa Corp., (Revised 12/3/1981).

According to the invention, a veneer slicer comprises a rotating carriage for holding a flitch and having an axis of rotation. A knife and pressure bar assembly is mounted on a reciprocable carriage for reciprocation toward and away from the axis of rotation of the rotating carriage. Means are provided for rotating the rotating carriage, and for reciprocating the reciprocating carriage toward and away from the axis of rotation as the flitch is carried around the axis of rotation on the rotating carriage to slice veneer from the flitch.

Illustratively, the rotating carriage includes means for holding multiple flitches, rotation of the rotating carriage by the means for rotating the rotating carriage, coupled with reciprocation of the means for reciprocating the reciprocating carriage causing veneer to be sliced sequentially from said multiple flitches.

Additionally, illustratively, the means for reciprocating the reciprocating carriage comprises means for reciprocating the reciprocating carriage to provide sheets of veneer having different profiles transverse to their lengths.

The invention may best be understood by referring to the following description and accompanying drawings which illustrate the invention. In the drawings:

FIG. 1 illustrates a side elevational view of a system according to the present invention;

FIG. 2 illustrates an alternative detail to a detail of the system illustrated in FIG. 1;

Figure 4:
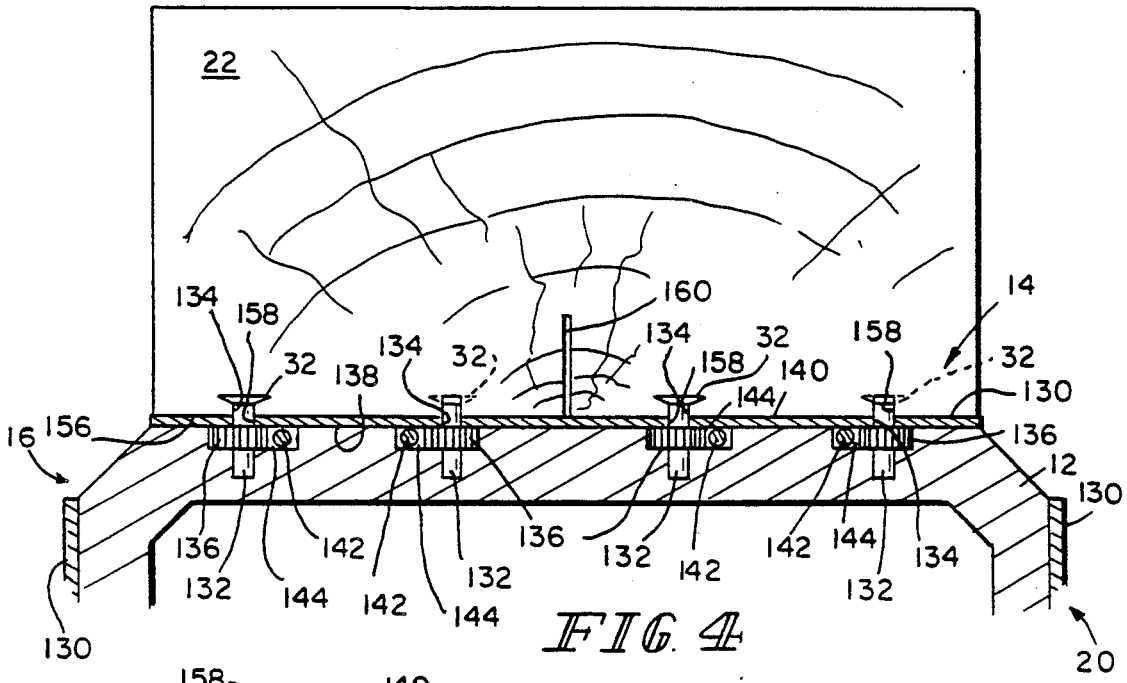
Figure 5:
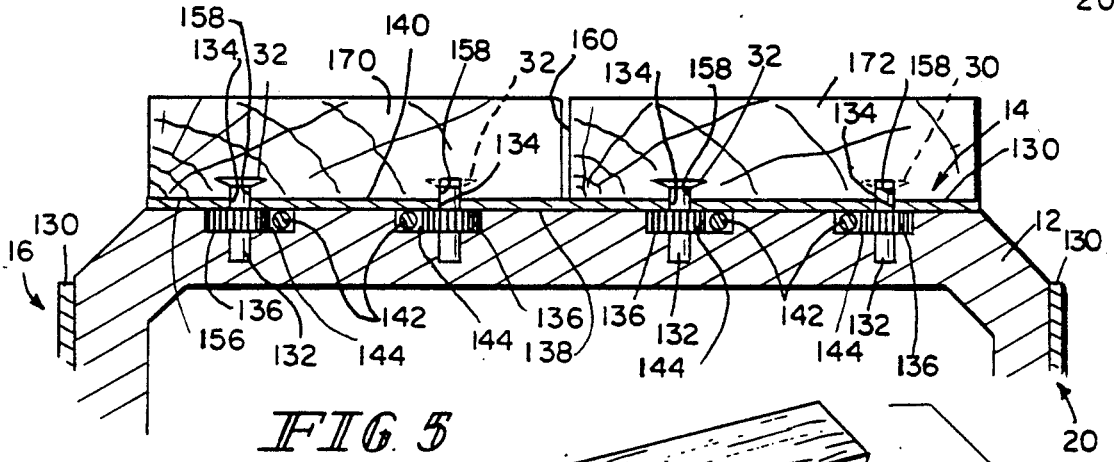
Figure 6:
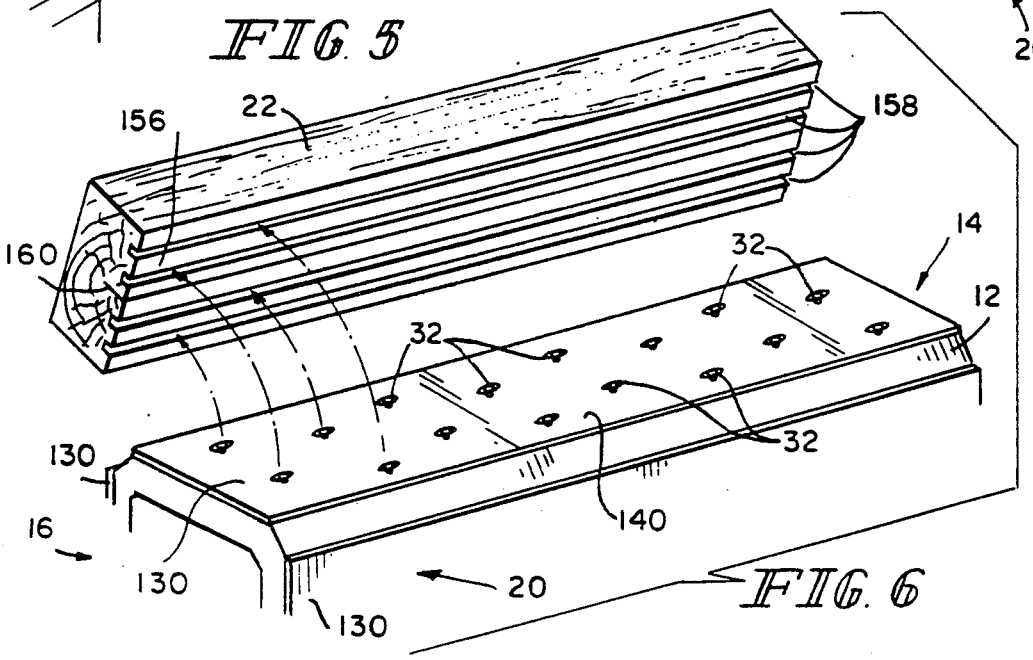
Figure 8:
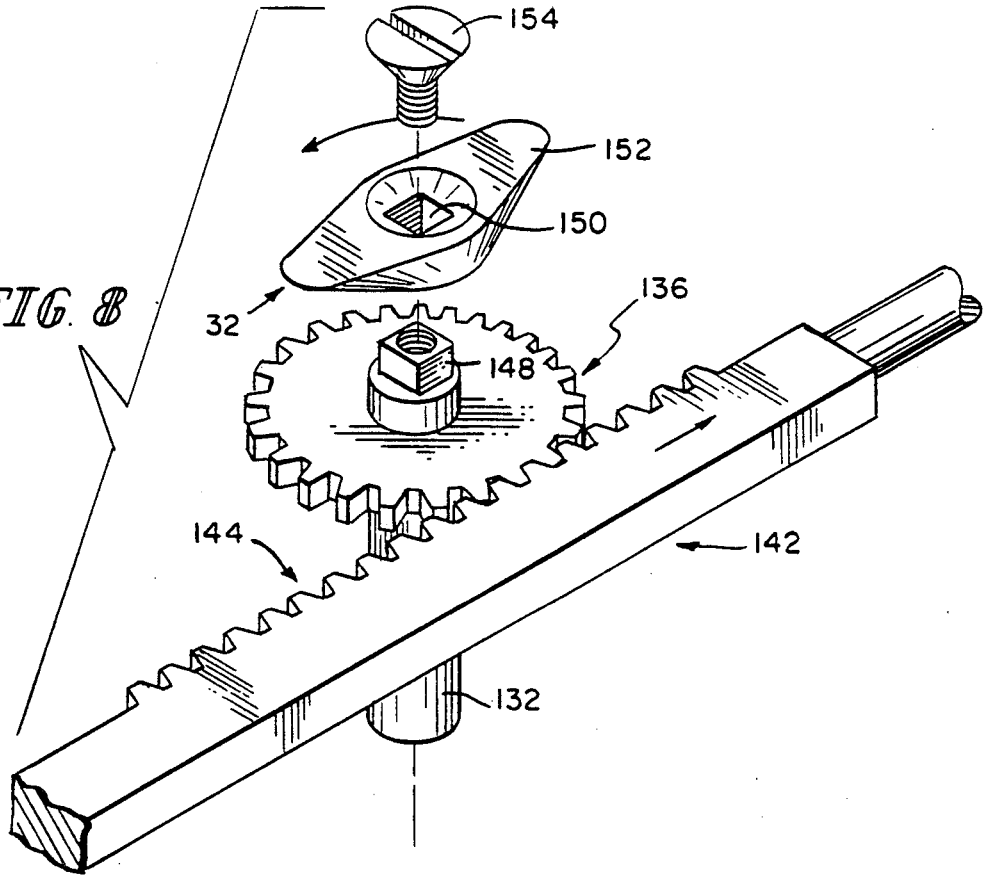
Figure 7:
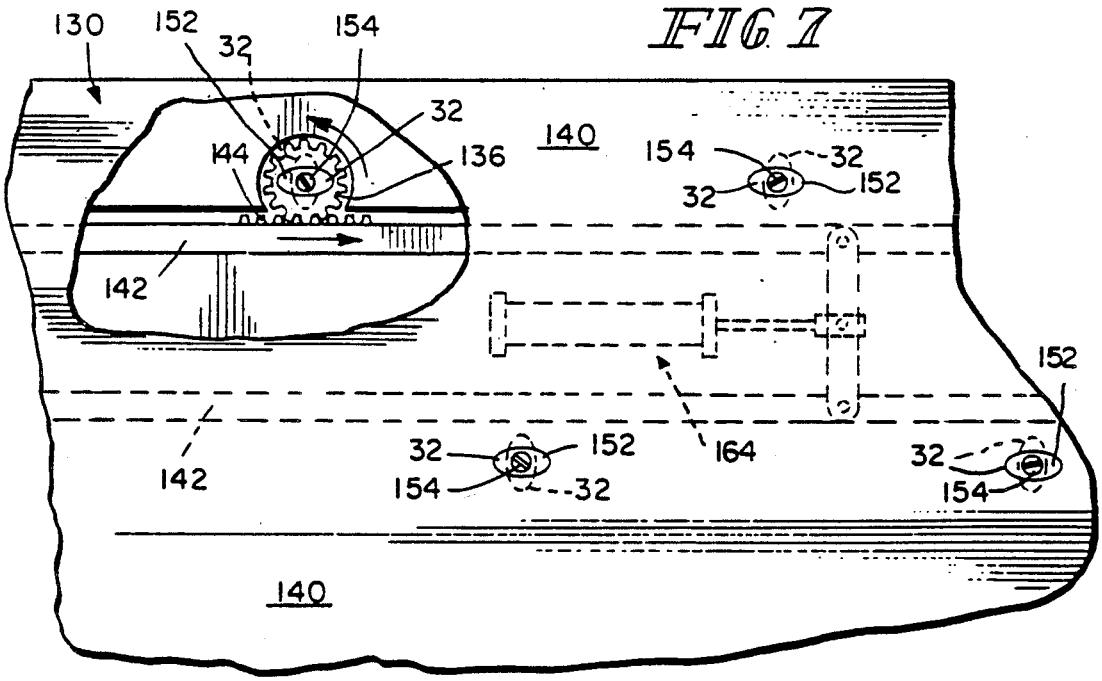

FIGS. 3*a–c* illustrate three different cutting profiles of which the system of the present invention is capable;

FIG. 4 illustrates fragmentarily an enlarged detail of the system illustrated in FIG. 1 at the beginning of a slicing operation;

FIG. 5 illustrates fragmentarily an enlarged detail of the system illustrated in FIG. 1 somewhat later in the slicing operation;

FIG. 6 illustrates fragmentarily an enlarged perspective view of a detail of the system illustrated in FIG. 1, prior to the beginning of a slicing operation;

FIG. 7 illustrates an enlarged fragmentary plan view of a detail of the system illustrated in FIG. 1; and, FIG. 8 illustrates an exploded perspective view of a detail of the system illustrated in FIG. 1.

Referring now to FIG. 1 a veneer slicing and stacking operation 10 is illustrated in side elevation. A generally square cross section, rotary flitch carriage 12 has four flitch holding stations 14, 16, 18 and 20. A flitch 22, 24, 26, 28 is held at each station 14, 16, 18, 20, respectively, by slicer dogs 32 of a configuration which will subsequently be discussed in greater detail. Flitch carriage 12 is also coupled to a prime mover (not shown) which rotates flitch carriage 12 at a controlled rate of, for example, <25 rpm about its axis 36. A carriage 40 supports a knife and pressure bar assembly 42 of known configuration.

Carriage 40 moves synchronously with flitch carriage 12 in several ways. First, carriage 40 steps linearly toward flitch carriage 12 once each complete rotation of flitch carriage 12. The size of each such step is determined by the desired thicknesses of the sheets 44 of veneer which are to be sliced from flitches 22, 24, 26, 28 as flitch carriage 12 rotates. A second motion, which is superimposed on the first, is a back-and-forth reciprocation of carriage 40, continuously synchronized to the rotation of flitch carriage 12. In other words, this second, reciprocating, motion is not simply a step toward flitch carriage 12 once each complete rotation of flitch carriage 12. Rather, this second motion reconciles the radial position of the knife and pressure bar assembly 42 with respect to the axis 36 of flitch carriage 12 on the one hand with the desired transverse sectional profiles of the sheets 44 of veneer on the other. For example, FIG. 3*a* illustrates somewhat exaggerated a convexly bowed profile cut 50 on a flitch 52. This cut 50 produces slightly outwardly bowed sheets of veneer after the first sheet has been taken off. This cut 50 requires either no additional motion or only a slight reciprocating motion of carriage 40 toward axis 36 to be made at a fairly linear rate from the time the flitch 52 engages knife 54 until knife 54 reaches the halfway point 56 in its cut. Then knife 54 is reciprocated in the same fashion away from axis 36.

FIG. 3*b* illustrates in somewhat exaggerated fashion a flat profile cut 60 on a flitch 62. This cut 60 produces flat sheets of veneer after the first sheet has been taken off. This cut 60 requires slightly more reciprocation of carriage 40 toward axis 36 than did cut 50 of FIG. 3*a*. However, again, the reciprocation can be made at a fairly linear rate from the time the flitch 62 engages knife 64 until knife 64 reaches the halfway point 66 in its cut. Then knife 64 is reciprocated at the same rate away from axis 36.

FIG. 3*c* illustrates in somewhat exaggerated fashion a concavely bowed profile cut 70 on a flitch 72. This cut 70 produces slightly concavely bowed sheets of veneer after the first sheet has been taken off. This cut 70 requires slightly more reciprocation of carriage 40 toward axis 36 than did cut 60 of FIG. 3*b*. However, again, the reciprocation can be made at a fairly linear rate from the time the flitch 72 engages knife 74 until knife 74 reaches the halfway point 76 in its cut. Then knife 74 is reciprocated at the same rate away from axis 36.

It is customary to maintain all of the veneer slices from a flitch 22, 24, 26, 28 together for sale. This is desirable because the coloring and grain texture vary somewhat from tree to tree and, if veneer slices are to be used in the manufacture of, for example, an article of furniture, it would not be desirable to mix colors and grain textures on finished surfaces of that article of furniture. To that end, a stacker 80 according to the invention separately stacks the veneer sheets 44 from the four different flitches 22, 24, 26, 28 in four stacks 82, 84, 86, 88, respectively. To accomplish this objective, the sheets 44 are conveyed upward from carriage 40 by a short section 90 of conveyor from which they are transferred between two facing conveyor 92, 94 runs. The sheets 44 are conveyed between conveyor 92, 94 runs to a point 96 at which conveyor 94 returns. Conveyor 92 passes beneath a vacuum box 100 which contains controlled vacuum dampers (not shown). Conveyor 92 continues to carry sheets 44 back toward carriage 40 until a particular sheet 44 is positioned over the stack 82, 84, 86, 88 of sheets sliced from its respective flitch 22, 24, 26, 28. As each sheet 44 reaches this position, a vacuum damper over it operates, releasing that sheet from conveyor 92 and depositing it in its correct order on its respective stack 82, 84, 86, 88. When slicing of flitches 22, 24, 26, 28 is complete, the respective stacks 82, 84, 86, 88 are removed for further processing, such as drying and new flitches are mounted on carriage 12.

FIG. 2 illustrates a generally triangular cross section, rotary flitch carriage 112 having stations 114, 116 and 118 for holding three flitches 122, 124 and 126 for slicing. Similar carriages can be provided for simultaneously slicing any practical number of flitches.

It should be understood that the control system for controlling the motion of carriage 40 must be capable of accounting not only for the desired veneer slice 44 thickness and profile 50, 60, 70. It must also take into account that as the flitches 22, 24, 26, 28 are sliced, the rate of rotation of the flitch carriage 12 may need to be reduced to maintain a constant surface angular velocity past the knife and pressure bar assembly 42. The controller must also take into account that, owing to the increasing width of each flitch 22, 24, 26, 28 nearer the rotary flitch holder 12, contact between the flitch 22, 24, 26, 28 and the knife and pressure bar assembly 42 will occur sooner in each successive rotation of the carriage 12, and will terminate later in each successive rotation of the carriage 12. The controller can sense slight changes in the rate of rotation of flitch carriage 12 when the knife and pressure bar assembly 42 contacts, and while it remains in contact with, a flitch which is being sliced. Control systems which serve these functions are known. Reference is here made to the above-noted control system disclosures, which are hereby incorporated herein by reference.

Turning now to FIGS. 4–8, each position 14, 16, 18, 20 on carriage 12 is provided with a plurality, illustratively sixteen, of dogs 32 for holding a respective flitch 22, 24, 26, 28 for slicing. Position 14 and flitch 22 are illustrated in greater detail in FIGS. 4 and 6. A stainless steel backing plate 130 is provided at each of the flitch-mounting positions 14, 16, 18, 20. Typically, the backing plates 130 are bolted to the carriage 12 by corrosion-resistant bolts, and the spaces between the bolts and plate 130 are filled with an inert epoxy. These steps and materials are necessary to avoid corrosion of the backing plates 130, the bolts and, to the extent possible, the Carriage 12 by acids produced as the flitches 22, 24, 26, 28 are prepared for slicing. A driveshaft 132 protrudes through a bearing opening 134 provided therefor at each of the sixteen locations on backing plate 130. A pinion gear 136 is provided on each driveshaft 132 adjacent the surface 138 of each backing plate 130 remote from its flitch-mounting surface 140. Dogs 32 are divided into four longitudinally extending groups of four and a drive rod 142 with rack sections 144 fixed thereto extends longitudinally adjacent each group of four dogs 32. The rack sections 144 engage respective pinion gears, and the drive rods 142 which drive adjacent groups of pinion gears 136 are on opposite sides of their respective groups. See FIGS. 4–5.

As best illustrated in FIG. 8, each driveshaft 132 has a reduced-size square head 148. Each dog 32 has a square cross-section socket for receiving the square head 148 of its respective driveshaft 132 to mount the dogs 32 non-rotatably on their respective driveshafts 132. Each dog 32 also has a countersunk opening 150 provided in its outer, flat surface 152 to receive a fastener 154 for attaching the dog 32 to the shaft 132. The dogs 32 are sharp-edged and are somewhat elliptical in plan view. During the preparation of the flitch 14, 16, 18, 20 for slicing, the back surface 156 of the flitch is provided with four grooves 158 whose width is the same length as, or slightly larger than, the minor axis of the dog 32. In no event should the width of the groove 158 be greater than the major axis of the dog 32. The back surface 156 is also provided with a saw cut 160 at the midpoint of its width. The depth of the saw cut 160 will vary depending upon the hardness of the wood and the tightness of the grain. Generally, however, the depth of the saw cut 160 will range somewhere between 3 inches and 6 inches (7.62 cm and 15.24 cm).

Once the flitch 14, 16, 18, 20 is positioned properly on its respective backing plate 130, a drive mechanism, illustrated as a hydraulic cylinder 164 in FIG. 7 is actuated. This drives the pair of drive rods 142 which are coupled to that cylinder 164 lengthwise of the flitch, turning the pinions 144 associated with each drive rod 142 a quarter turn, causing the sharp edges of the dogs 32 to dig into the walls of each groove 158. Because the rods 142 are on opposite sides of the pinions 144 of adjacent pairs, the forces exerted by the dogs 32 on the flitch are balanced and there is no tendency to drive the flitch in either direction on the mounting plate 130.

Slicing of the flitch proceeds as previously discussed until the knife and pressure bar assembly 42 reaches the saw cut 160. At that time, rotation of the carriage 12 is stopped and one 170 of the two resulting pieces 170, 172 is turned end for end and re-mounted on the mounting plate 130 so that the grains of both pieces 170, 172 extend in the same direction. This reduces the likelihood of opening up the grain of the veneer that is sliced from pieces 170, 172 during the late stages of the slicing operation.

What is claimed is:

1. A veneer slicer comprising a rotating carriage for holding multiple flitches, the rotating carriage having an axis of rotation, a knife and pressure bar assembly, a reciprocable carriage for reciprocating the knife and pressure bar assembly toward and away from the axis of rotation of the rotating carriage, means for rotating the rotating carriage, and means for reciprocating the reciprocating carriage toward and away from the axis of rotation as the flitches are carried around the axis of rotation on the rotating carriage, rotation of the rotating carriage by the means for rotating the rotating carriage, coupled with reciprocation of the means for reciprocating the reciprocating carriage toward and away from the axis of rotation as the flitches are carried around the axis of rotation causing veneer to be sliced sequentially from said multiple flitches.

2. The invention of claim 1 wherein the means for reciprocating the reciprocating carriage comprises means for reciprocating the reciprocating carriage to provide sheets of veneer having selected different profiles transverse to their lengths.

3. A veneer slicer comprising a rotating carriage for holding a flitch, the rotating carriage having an axis of rotation, a knife and pressure bar assembly, a reciprocable carriage for reciprocating the knife and pressure bar assembly toward and away from the axis of rotation of the rotating carriage, means for rotating the rotating carriage, and means for reciprocating the reciprocating carriage toward and away from the axis of rotation as the flitch is carried around the axis of rotation on the rotating carriage to provide sheets of veneer having selected different profiles transverse to their lengths.

4. The invention of claim 3 wherein the rotating carriage includes means for holding multiple flitches, rotation of the rotating carriage by the means for rotating the rotating carriage, coupled with reciprocation of the means for reciprocating the reciprocating carriage toward and away from the axis of rotation as the flitches are carried around the axis of rotation causing veneer to be sliced sequentially from said multiple flitches.

* * * * *